US009957744B2

(12) United States Patent
Hamman et al.

(10) Patent No.: US 9,957,744 B2
(45) Date of Patent: May 1, 2018

(54) POWER TOOL TO SPRING TORSIONER CONVERTER

(71) Applicants: Gary L. Hamman, Garland, TX (US); Diana L. Hamman, Garland, TX (US)

(72) Inventors: Gary L. Hamman, Garland, TX (US); Diana L. Hamman, Garland, TX (US)

( * ) Notice: Subject to any disclaimer, the term of this patent is extended or adjusted under 35 U.S.C. 154(b) by 0 days. days.

(21) Appl. No.: 15/271,290

(22) Filed: Sep. 21, 2016

(65) Prior Publication Data

US 2017/0008158 A1 Jan. 12, 2017

Related U.S. Application Data

(63) Continuation-in-part of application No. 14/025,827, filed on Sep. 13, 2013, now abandoned.

(51) Int. Cl.

| | |
|---|---|
| ***E05F 11/00*** | (2006.01) |
| ***B25B 21/00*** | (2006.01) |
| ***B25B 27/30*** | (2006.01) |
| *E05D 13/00* | (2006.01) |

(52) U.S. Cl.

CPC ..... *E05F 11/00* (2013.01); *B25B 21/002* (2013.01); *B25B 27/306* (2013.01); *E05D 13/1261* (2013.01); *E05Y 2201/492* (2013.01); *E05Y 2800/692* (2013.01)

(58) Field of Classification Search

CPC ..... B60B 29/007; B60B 29/003; B25B 23/00; B25B 15/02; B25B 13/48; B25B 21/002; E05F 11/00; E05D 13/1261

USPC ..... 81/460–462, 464, 57.36

See application file for complete search history.

(56) References Cited

U.S. PATENT DOCUMENTS

| | | | | |
|---|---|---|---|---|
| 2,264,012 | A * | 11/1941 | Wasson | B25B 21/004 74/129 |
| 3,570,331 | A * | 3/1971 | Rogers | B25B 21/004 81/54 |
| 3,979,977 | A * | 9/1976 | Dorma | B25B 21/002 81/57.13 |
| 6,615,897 | B2 * | 9/2003 | Dorma | E05D 13/1261 16/197 |
| 6,644,378 | B2 * | 11/2003 | Mitchell | E05D 13/1261 160/191 |

* cited by examiner

*Primary Examiner* — Monica Carter
*Assistant Examiner* — Danny Hong

(57) ABSTRACT

A device to apply a rotational force to a spring of a rollup or overhead garage door counterbalancing mechanism. The device has a rotatable driven member mounted in a housing. The housing and the driven member have slots with an open end adapted to receive the shaft of the overhead garage door counterbalancing mechanism. A coupling member is configured to mount to the driven member and connect the driven member to the winding cone of a garage door spring to apply rotational force to the spring. The housing with the driven member may be connected to the body of an existing power tool in place of the original tool head, or, the housing may be permanently combined with a motor and transmission to provide a special purpose tool.

8 Claims, 6 Drawing Sheets

POWER TOOL TO SPRING TORSIONER CONVERTER

CROSS REFERENCE TO RELATED APPLICATIONS

This Application is a Continuation-in-Part of U.S. Non-Provisional Application Ser. No. 14/025,827 of the same title, and having a filing date of Sep. 13, 2013.

BACKGROUND OF INVENTION

Field of the Invention

Implements or devices for applying rotational force to a spring.

Description of Related Art

Power tools, using air or electric motors, are commonly used to rapidly turn nuts, bolts, and screws. However, these tools as currently marketed are not designed to apply twisting (torsion) forces to the springs of a counterbalancing garage door mechanism.

Most of the foregoing door mechanisms utilize long coil springs that are placed under a rotational or torsion force to apply a lifting force to the door. The springs are concentrically positioned about a rotatable shaft mounted on fixed supports. The shaft carries drums accommodating cables, and these cables are attached to the bottom panel of the door so that when the drums are rotated, a lifting force will be applied to the door. The lifting force is transmitted from the torsion springs to the drums by the shaft. The springs must be anchored on one end, and the free end connected to a winding cone on the shaft, and the winding cone is then rotated to "load" the springs; e.g., place the springs under torsion force. When the torsion force is "loaded," the winding cone is then connected to the shaft by a mechanical means, and the system is ready.

Previously, long steel rods have been used to insert into open bores in the winding cone to rotate the winding cone and "load" the spring. The amount of force that can be applied to the spring is limited by the strength of the person using the rods, since rotating the winding cone in this manner is a manual operation. The procedure requires a considerable amount of time and can be dangerous as the spring becomes loaded with considerable force.

While there have been other devices patented to introduce temporary mechanical power to "load" these door springs, such designs required some setup work over the shaft or at the winding cone for each spring, before they could begin to "load" the spring. Still other devices are for permanently installed mechanisms, increasing both the installation and subsequent repair costs.

The current invention is safer to use than a manual procedure, and eliminates the setup times typical of past devices.

It would be further desirable to to provide a device with relatively few moving parts to wear out, eliminating the increased costs associated with the permanently installed mechanisms.

SUMMARY OF THE INVENTION

Embodiments of the invention relate to an apparatus for applying rotational force to an object, as a fastener, a fastener assembly, or a winding cone connected to a spring of a door counterbalancing mechanism. More particularly, some embodiments of the device may convert certain common power tools such as pipe threaders or handheld grinders into a tool to apply rotational force to a torsion coil spring of a door counterbalancing mechanism. Some embodiments of the device may be a standalone; i.e., special purpose tool.

In one aspect, wherein a common power tool such as a drill or hand-held grinder is adapted to provide rotational force to a garage door spring, the device has a housing with a slot to accommodate the transverse insertion of a shaft of the overhead door counterbalancing mechanism. The housing is connected to a power tool, and more particularly to an output shaft of a power tool motor. The slot is formed in a driven member which may be the gear portion of a worm gear. The slot terminates in a semi-octangonal aperture that is formed to receive a post portion of a slotted coupling member. The coupling member has an engagement member configured to couple to a winding cone of the overhead door counterbalancing mechanism. The rotatable driven member is housed in the housing. When the slot of the driven member is aligned with the slot of the coupling member a passageway is formed for the introduction of the transverse section of a shaft of the overhead door counterbalance mechanism. A power transferring means; e.g., transmission, is contained in the housing, and may be a speed reducer of any conventional configuration as would be appreciated by those having skill in the art and which can possess any reduction ratio that can continuously and synchronously drive the driven member and the coupling member mounted thereto. A motor, such as an electric motor, is used to apply power to the transmission. One form of the coupling member includes a hook member aligned to engage an open bore in the winding cone. Those having skill in the art and access to this disclosure will appreciate that alternate engagement members can be incorporated with the coupling member.

In another aspect of the present invention, the housing may be combined permanently with an electric motor and a transmission to create a specific use tool for rotationally winding a coil of a garage door assembly.

One object of the present invention is to provide a power tool, usable with no set up required, to apply torsion forces to the spring of a door counterbalancing mechanism.

Another object of the present invention is to provide an apparatus which is simple, safe and convenient to use and requires only one person.

Another object of the invention is to provide a power tool for applying torsion forces to the spring of a door counterbalancing mechanism that is operable, with a minimum of time and effort, to apply the torsion forces to the spring sufficient to counterbalance the door.

Another object of the invention is to provide a power tool that includes a motor that is compact in construction, relatively lightweight and efficient in use to apply torsion forces to the spring of a door counterbalancing mechanism.

Yet another object of the invention is to provide a reliable power tool with a driven member having a slot to accommodate an object, as a shaft, so that the driven member can be concentrically located with the shaft whereby on rotation of the driven member rotational forces can be applied to an object mounted on the shaft.

Other objects and advantages of the invention are embodied in the following description of the embodiments of the invention.

BRIEF DESCRIPTION OF THE DRAWING FIGURES

LISTING OF REFERENCED ELEMENTS

Figure 1:
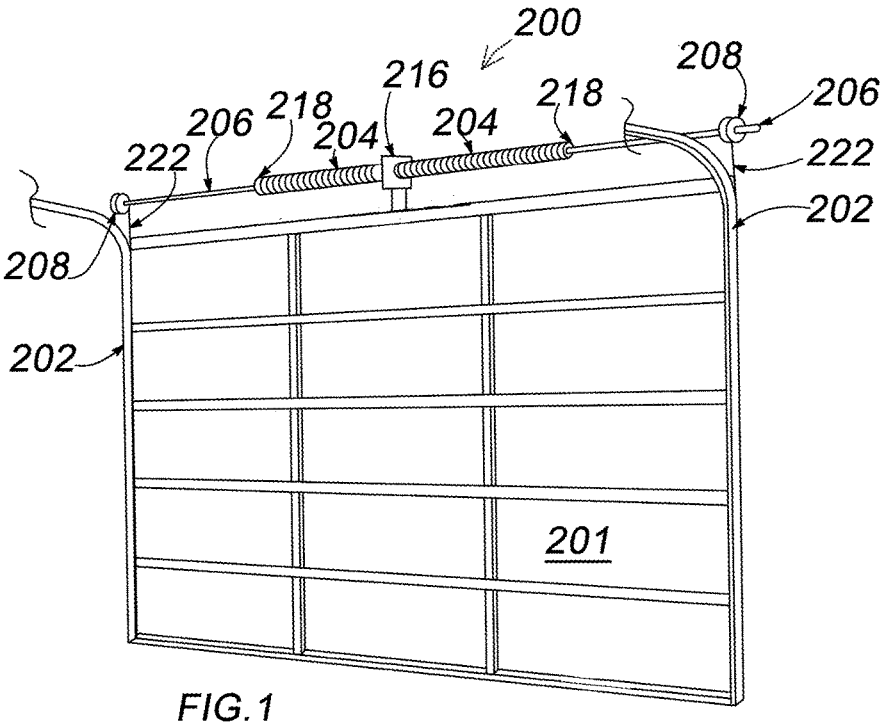
FIG. 1 shows an elevation view of a prior art sectional overhead door in the closed position.

80 garage door coil torsioning apparatus
100 housing
102 handle
106 driven member
108 snap ring
110 coupler retainer
112 housing shaft slot
114 worm gear
116 worm
117 shaft
118 transmission
120 motor
122 coupling member
123 coupler cap
124 coupler fasteners
125 coupler body
126 coupler post
128 coupler post prongs
130 coupler shaft slot
131 engagement hook
132 engagement recess
200 garage door counterbalance mechanism
201 garage door
202 garage door tracks
204 coil springs
206 shaft
208 shaft drum
210 shaft bearing
212 anchor cone
214 cone set screw
216 central support
218 winding cone
219 open bore
220 tabs
222 cable

Definitions

Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. It should be understood that the objects, features and aspects of any embodiment disclosed herein may be combined with any object, feature or aspect of any other embodiment without departing from the scope of the invention. The term "comprises" means "includes." All publications, patent applications, patents, and other references mentioned herein are incorporated by reference in their entirety for all purposes. In case of conflict, the present specification, including explanations of terms, will control. In addition, the materials, methods, and examples are illustrative only and not intended to be limiting.

DETAILED DESCRIPTION OF THE EMBODIMENTS

In order that the various embodiments of the invention be fully understood, it is necessary to describe in sufficient detail the structure and function of coil type garage door counterbalance mechanisms.

Figure 2:
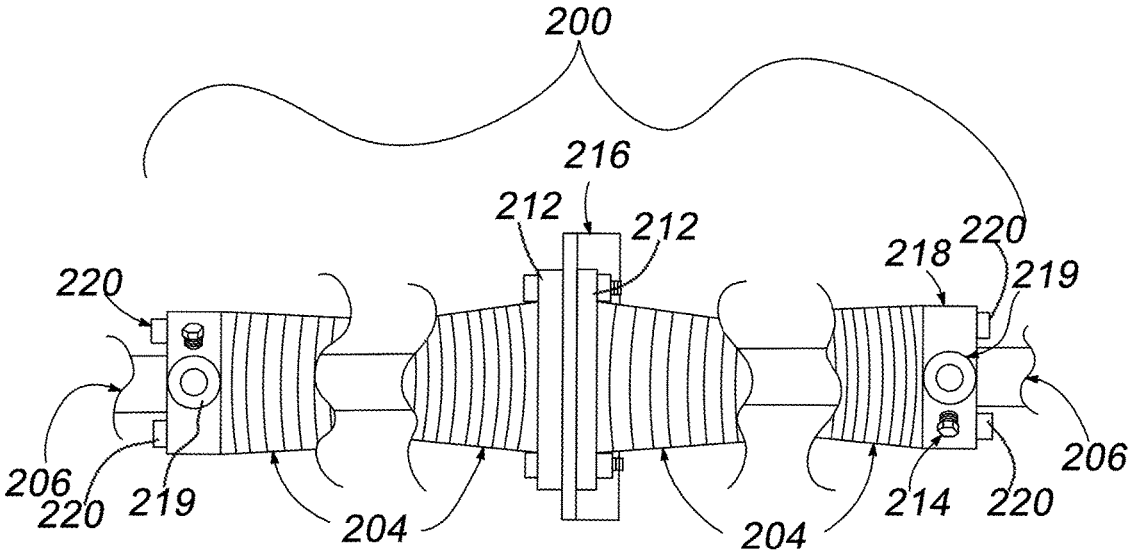
FIG. 2 shows a fragmentary elevation view of the prior art spring area of the counterbalancing mechanism.
Figure 3:
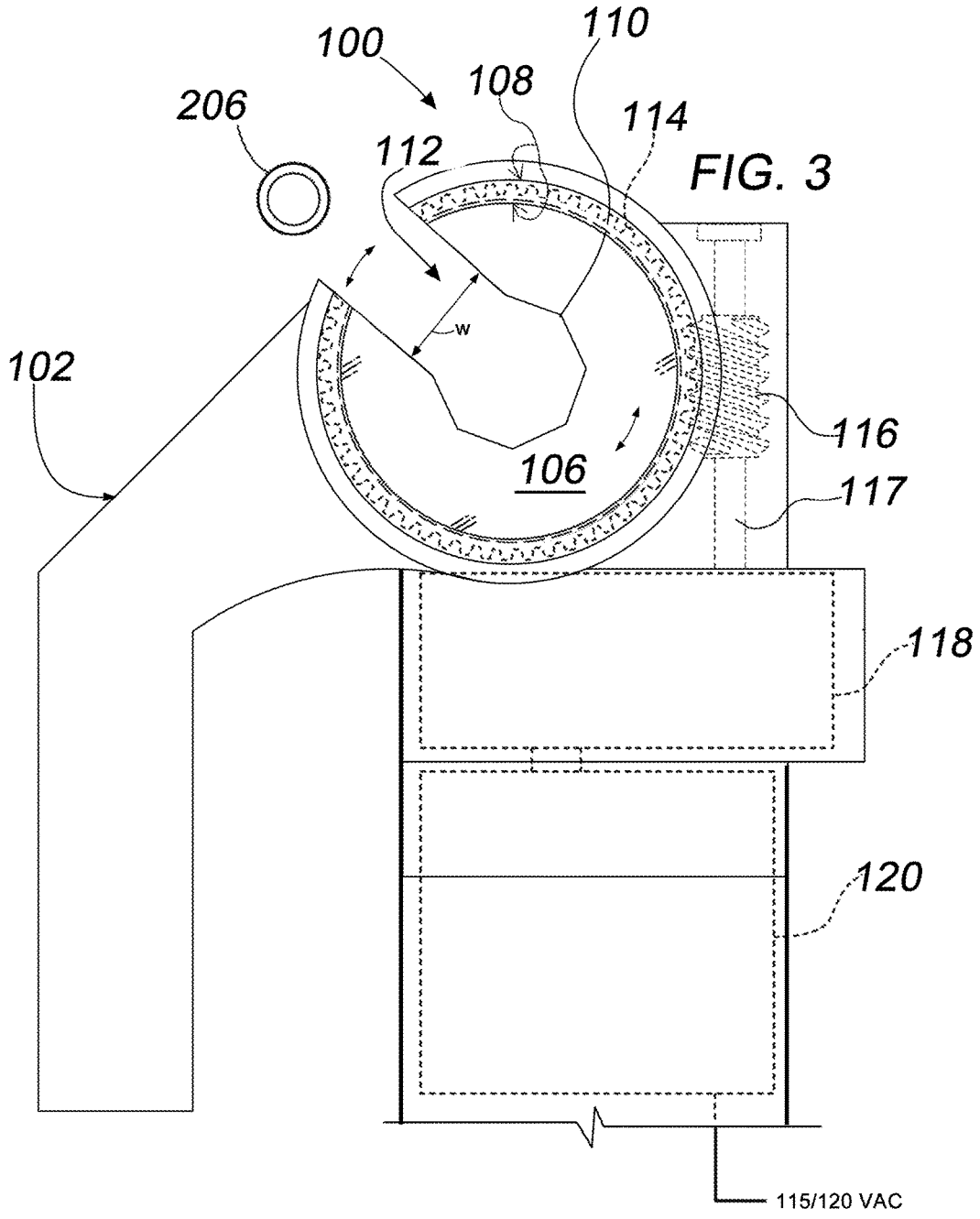
FIG. 3 shows a side elevation view of the housing portion of one embodiment of the invention, wherein the opposite side is substantially a mirror thereof.

Explanation of Common Garage Door Assemblies:

Prior Art FIGS. 1 and 2 show common coil spring counterbalanced garage door assemblies. FIG. 1 shows a conventional overhead door 201 in the closed position mounted against a wall. Overhead doors are usually made of metal, plastic or wood panels and have considerable weight. FIG. 2 shows a counterbalance mechanism 200 which is used to facilitate the safe and easy opening and closing of door 201.

Counterbalance mechanism 200 is located above the top of door 201 and has a generally transverse shaft 206. Transverse shaft 206 is typically either a hollow tube or solid bar, the material determined by the weight to be lifted. Opposite end portions of shaft 206 are supported in bearing supports 210. The center portion of shaft 206 is supported by central bearing support 216 which is itself supported by a mount affixed to the wall. In some installations, shaft 206 may be supported in bearings on the remote ends of the garage door tracks 202. Drums 208 are concentrically mounted to the shaft via a set screw in the positions shown, and rotate with the shaft. A cable 222 is wound about each drum, with one end of the cable tethered to the drum, and the other end attached to the lower end of the garage door. Shaft 206 is subjected to rotational forces by a pair of coil or helical springs 204 with typically one end of each coil spring 204 free to turn with the shaft 206, terminating with a winding cone 218, while the opposite end of each spring is constrained from turning by an anchor cone 212. When door 201 moves from the open to the closed position, springs 204 are energized by the twisting action of shaft 206, and the shaft 206 rotates as door 201 moves to its closed position, inducing sufficient torque into springs 204 to counterbalance the majority of the weight of door 201. Springs 204 then have sufficient torque so that door 201 can be opened with little effort. When door 201 is in the open position, springs 204 must retain a small amount torque to keep cables 222 taut, preventing the accidental closing of door 201. During door installation, winding cones 218 must be rotated and then secured to shaft 206 by set screws when door 201 is in the closed position, in order to set the initial amount of torque in springs 204 required for proper operation of door 201.

Winding cones 218 have a plurality of radial open bores 219 for the purpose of receiving long removable rods which are used to manually load the springs, to selectively hold and rotate the cones ¼ turn per rod insertion, thereby applying torque to the springs. When sufficient torque is applied to the springs, winding cones 218 are secured to shaft 206 constraining the winding cones to rotate only with the shaft; i.e., not independently.

To obviate the task of manually loading the springs which can be an exhausting and dangerous procedure, the present invention enables one person to easily place the springs 204 under tension by turning the winding cones 218. Once the winding cones are loaded with the required torque, they are secured to shaft 206 in the same manner as with manual loading.

Referring generally to FIGS. 3-8, an overhead garage door coil torsioning apparatus 80 comprises a housing 100; typically a cast metal housing/casing includes the following sections: a reduction gear section 118, e.g., a transmission, worm section 116, the driven member 106 section and handle 102. The worm gear, that is, the gear portion 114 that the worm 116 drives may be the driven member having a slot formed the gear, or the driven member may be a slotted plate centrally mounted to gear 114. Where there is a slot is formed in gear 114, the gap width (w) of the slot 112 is less than the length of worm 116 so that the worm may bridge the extremities of the slot 112, meaning that a leading or trailing end of the slot is always in contact with the worm when passing the worm 116 irrespective of the direction of rotation of the gear portion 114, such that continuous non-intermittent rotational motion of the gear portion is possible. A motor housing 120*a* includes a reversible rotation electric motor 120 that is mounted to the transmission 118 of the housing 100. While typically the motor is powered by household current; e.g., 115/120 VAC, battery operation is possible. An on-off trigger switch and a reversing switch, typically on the motor housing are used to control the power to the motor.

In some embodiments, housing 100 may attach to an existing power tool body such as that of a hand held rotary grinder or a pipe threader by removing the existing head portion of the hand held power tool and substituting housing 100 which would be attachable to the hand held power tool by any suitable means, e.g., bolts and/or other fasteners. In such cases, a mounting portion of the housing would fastenably align with the original head portion of the grinder to the motor 120 housing of the hand held power tool. Once attached to the power tool motor housing, power is transmitted via the tool motor to the driven member 106; which in the particular embodiment depicted is gear 114 contained in the housing, worm 116 being driven by transmission 118 which is driven by the motor of the hand held power tool. Driven member 106 rests against a bearing shoulder of the housing of the same size as snap ring 108, and is secured in the housing 100 by snap ring 108. Driven member 106 has a slot 112 of a size required to accommodate shaft 206 and a concentric semi-octagonal hole to admit the coupling member 122, which also has a slot 130 adapted to admit shaft 206. Slots 112 and 130 are align-able and must be aligned in order to admit shaft 206. The opening in the cast housing 100 is slightly larger than slot 112 to allow for motor-spin and any movement of driven member 106 after electrical power cut-off.

Figure 4:
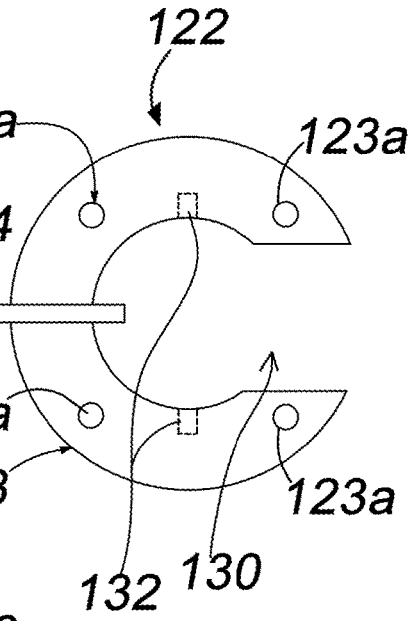
FIG. 4 shows a plan view of the top of the coupling member configured to mount to the housing portion.
Figure 5:
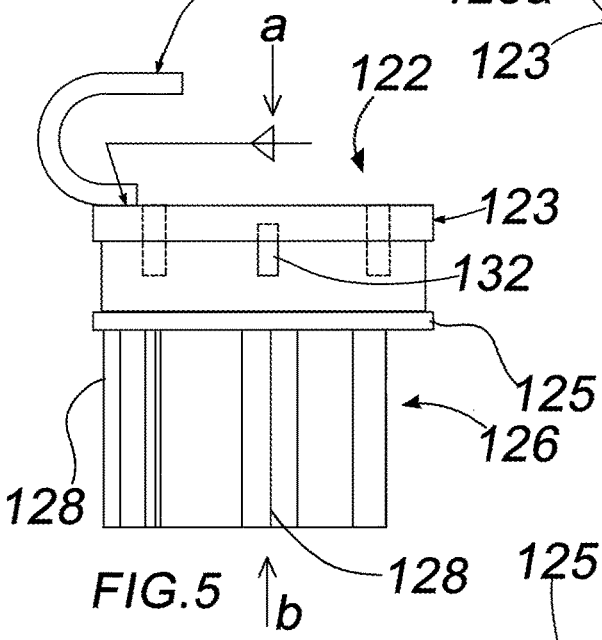
FIG. 5 shows a side elevation view of the coupling member.
Figure 6:
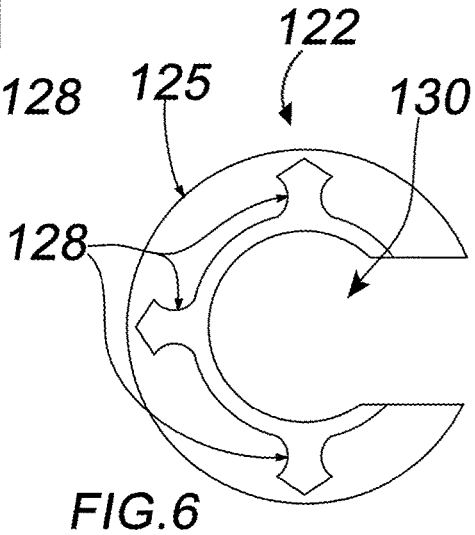
FIG. 6 shows a plan view of the bottom of the coupling member.
Figure 8:
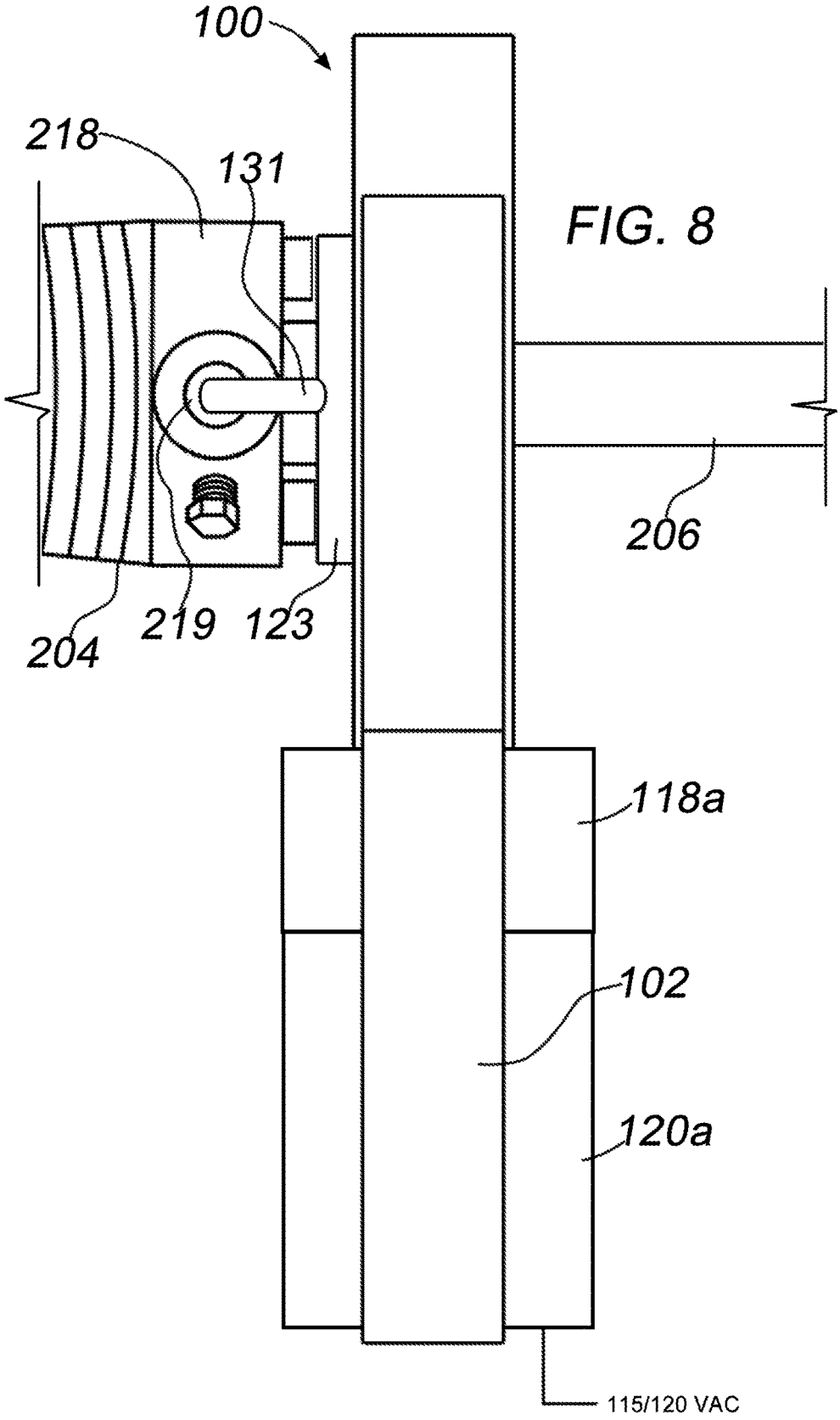
FIG. 8 shows the combined housing with coupling member 122 mounted to the shaft of a garage door counterbalance mechanism, with an engagement hook 131 secured to a winding cone.
Figure 4:
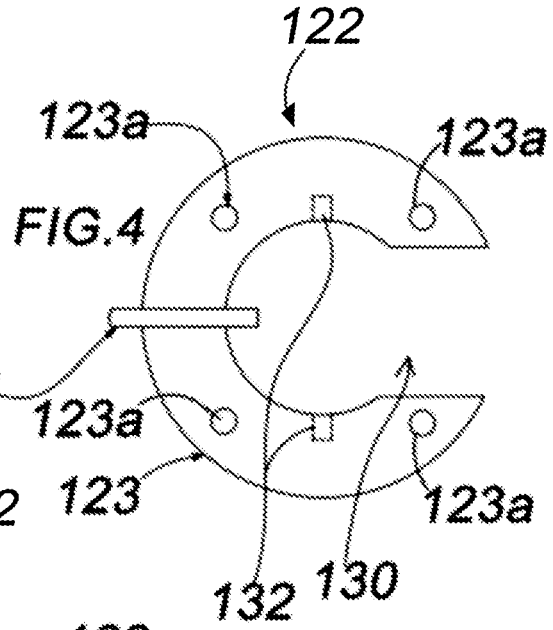
Figure 5:
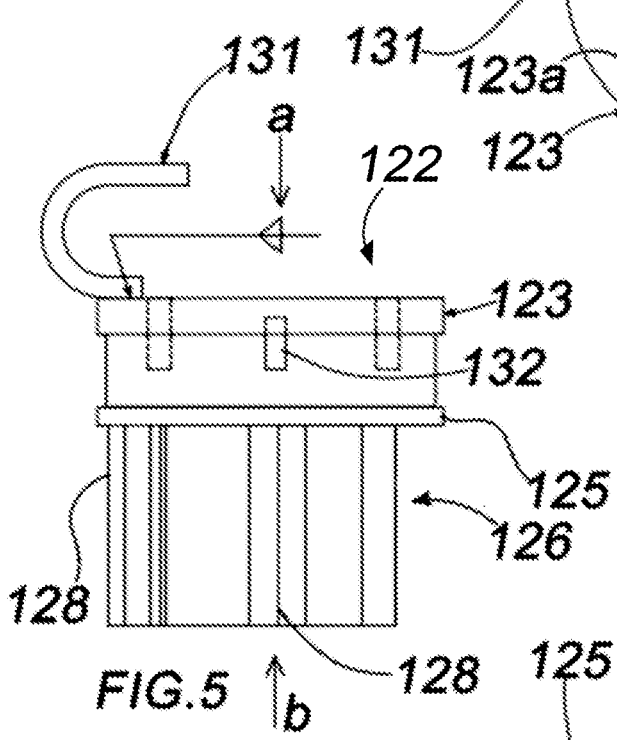
Figure 6:
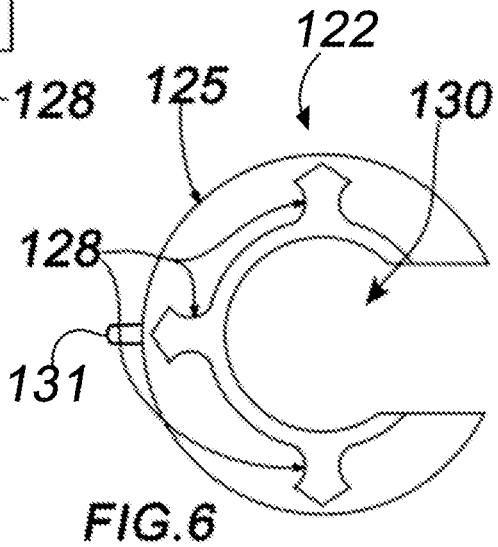

Referring to FIGS. 4-6 three views of coupling member 122 for connecting to and rotating the winding cones 218. The cap 123 of coupling member 122 may be an alloy such as chrome steel with four holes provided for fasteners, bolts, etc., to attach cap 123 to body 125. A stainless hook 131 is welded to cap 123 and engages an open bore 219 on either winding cone 218, in order to wind either spring 204 to the required torque. Coupling member 122 is inserted into coupler retainer 110 in driven member 106 from the side toward the spring to be wound as shown in FIG. 8. The tool with engaged coupling member is typically placed directly adjacent the winding cone to be wound with the projection of the hooked member 131 inserted directly into one of the open bores 119 of the winding cone 218. An alternative method of winding springs 204 is to omit cap 123 and engage tabs 220 on winding cones 218 into the slots 132 in body 125.

Body 125 of the coupling member has a post 126 with three prongs 128 which are configured to correspond with the semi-octagonal aperture/coupler retainer which firmly retains the coupling member 122 with an internal snap ring so that when coupler shaft slot 130 is aligned with shaft slot 112 of the driven member, and projections of the coupler post prongs 128 aligned with corresponding points of the semi-octagonal coupler retainer of driven member 106. This positions coupling member 122 concentrically with driven member 106, and with winding cones 218 and shaft 206, perfectly aligning all parts for winding springs 204 to the required amount of torque.

Figure 7:
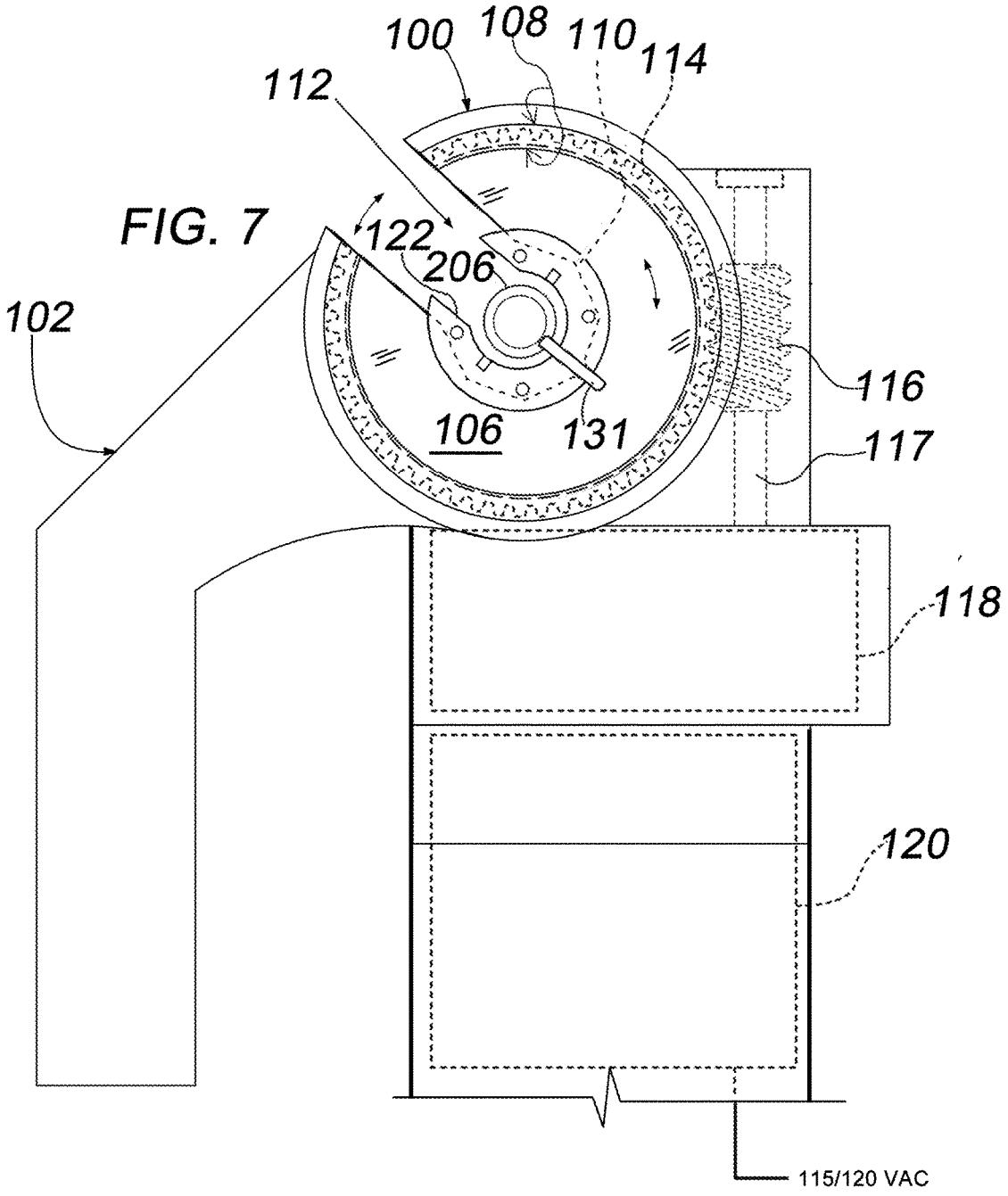
FIG. 7 shows a side elevation view of the housing with mounted coupling member 122.

FIG. 7 shows the coupling member 122 mounted to the housing 100 of the apparatus 80 wherein coupler post 126 is inserted into the coupler retainer 110 and aligned therein by post prongs 128.

FIG. 8 shows the apparatus 80 attached to shaft 206 with engagement hook 131 of the coupling member 122 engaged with a winding cone 218, wherein one end of the hook is inserted into an open bore 219 of the cone 218.

Housing 100 can also be used as a portable pipe threader to cut threads onto pipe ends by replacing coupling member 122 with the appropriate size pipe die and cutting blades.

While there have been shown and described preferred embodiments of the invention, it is understood that changes in materials, size of the components, power transmission structures, coupling structures and other components can be made by those skilled in the art without departing from the invention.

We claim:

1. An apparatus for applying rotational force to portions of a garage door assembly comprising: a housing; a driven member mounted to the housing having a first slotted portion; a transmission adapted to apply rotational force to the driven member; a coupling member including prongs adapted to mate with the driven member and rotate therewith, the coupling member further comprising at least a second slotted portion and one engagement member, the engagement member is adapted to engage portions of a winding member of a garage door assembly, and wherein the engagement member is rotatable.

2. The apparatus according to claim 1, wherein the coupling member has an opening configured to admit a shaft.

3. The apparatus according to claim 1, further comprising a coupler retainer adapted to mate with portions of the coupling member.

4. The apparatus according to claim 1, further comprising a motor adapted to engage with the transmission and provide motive force thereto.

5. The apparatus according to claim 1, wherein the at least one engagement member includes one or more slots or at least one hooked member.

6. The apparatus according to claim 1, wherein the housing and transmission are adapted to attach to portions of a pre-existing power hand tool.

7. The apparatus according to claim 1, comprising a prong for engagement with portions of a winding cone of an overhead door counterbalance assembly.

8. The apparatus according to claim 1, configured to receive a transverse portion of a shaft when at least the first slotted portion and the second slotted portion are aligned.

* * * * *